United States Patent [19]

Kisslinger et al.

[11] 4,077,518

[45] Mar. 7, 1978

[54] SENSOR TRANSPORT SYSTEM

[75] Inventors: Robert L. Kisslinger, University City; Benny B. Barnes, Kirkwood; Frederick L. Tuttle, Florissant, all of Mo.

[73] Assignee: The United States of America as represented by the Secretary of the Navy, Washington, D.C.

[21] Appl. No.: 786,908

[22] Filed: Apr. 12, 1977

[51] Int. Cl.[2] ..... B65D 81/10; B65D 85/38

[52] U.S. Cl. ..... 206/583; 206/591; 248/18; 248/20

[58] Field of Search ..... 206/583, 591, 521; 248/18, 19, 20, 21, 358 R; 179/100.1 R

[56] References Cited

U.S. PATENT DOCUMENTS

| | | | |
|---|---|---|---|
| 2,289,514 | 7/1942 | Mastney et al. | 248/20 |
| 2,335,779 | 11/1943 | Mazzei | 206/583 |
| 2,595,135 | 4/1952 | Greenslade | 248/18 |
| 3,323,764 | 6/1967 | Johnson | 248/358 AA |
| 3,428,279 | 2/1969 | Johnson | 248/21 |
| 3,735,952 | 5/1973 | Platus et al. | 206/591 |

*Primary Examiner*—William T. Dixson, Jr.

*Attorney, Agent, or Firm*—R. S. Sciascia; L. I. Shrago; C. E. Vautrain, Jr.

[57] ABSTRACT

A transport system for fragile instruments such as the motion sensors used in aircraft flight controls which are very susceptible to damage during handling, shipment and installation is provided. Individual sensors are mounted on a plate that is suspended inside the permanent housing of the equipment by springs which act as shock-vibration insulators. The housing is spring-isolated in an outer casing for transport, and the plate is permanently secured to the housing at the installation site simply by tightening bolts which extend through the housing.

11 Claims, 5 Drawing Figures

SENSOR TRANSPORT SYSTEM

This invention concerns shock and vibration absorbing mountings and, more particularly, a vibration and shock mounting for fragile instruments which becomes part of the instrument's permanent installation.

One of the primary problems in the reliability of motion sensors used in aircraft flight control systems is the damage incurred during handling of the device between the point of manufacture or overhaul and the physical installation in the air vehicle. This is primarily true with regard to rate gyroscopes since the spring restraints, commonly a torsion bar device for providing the rate sensitivity, can be broken by handling shocks. For redundant flight control systems, the sensors are normally packed in some grouping, with precision machined mounting within an overall cover which is installed in the air vehicle. Dropping this package, which is generally termed a sensor unit, for as short a distance as 1 inch onto a work bench can result in damage to one or more of the sensors within the unit thereby necessitating removal and repair of the damaged sensor.

The only known method of protecting such units is to insert shock absorbing material within the shipping container and to apply to the container labels indicating the fragile contents. This method, however, does not protect the unit prior to its being placed in the container or subsequent to its removal therefrom, except for the exercise of caution by personnel experienced in handling such fragile and sensitive material. The system of the present invention provides a considerable improvement in protection from damage due to mishandling at all stages of these and other highly sensitive units including packaging, shipment and installation in the air vehicle.

Accordingly, it is an object of the present invention to provide a system for protecting a variety of types of instruments from damage during handling, shipping, and installation.

Another object of this invention is to provide a system for protecting sensitive instruments from damage due to mishandling, vibration, shock, etc. which becomes a permanent mount on installation of instruments.

A further object of this invention is to provide a vibration and shock mounting for fragile instruments which is effective during all stages of handling from packaging to installation and wherein the transition between a floating mounting and the secured position is effected by simple adjustment.

Other objects, advantages and novel features of the invention will become apparent from the following detailed description thereof when considered in conjunction with the accompanying drawings in which like numerals represent like parts throughout and wherein.

Figure 2:
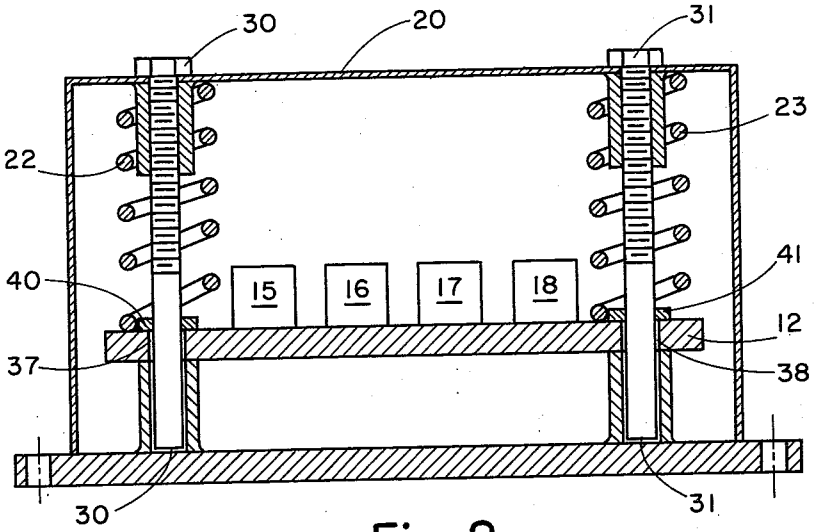
FIG. 2 is a sectional schematic view of the embodiment of FIG. 1 in the installed position.

The present invention provides, in general, a transport system for fragile instruments such as the motion sensors used in aircraft flight controls which are very susceptible to damage during handling, shipment and installation. To protect such instruments, individual sensors are mounted on a machined plate which controls their alignment with respect to each other. The plate is suspended from the inside of a casing by springs which act as shock-vibration isolators and is also held fixed in the horizontal direction by additional springs which isolate from shock and vibration. The entire unit may be installed in an aircraft or other vehicle using a conventional bolt pattern and alignment holes or pins to provide proper orientation with the vehicle. The restraints are then screwed down into the unit to clamp the sensor mounting plate to the precision machined alignment posts to provide the same quality of operation as though the sensors had been fastened directly to the base of the unit.

Referring to the drawings, a sensor transport system is indicated generally at 11 and includes a plate 12 on which a plurality of sensors or other fragile instruments 15–18 are secured. Plate 112 is suspended in its ultimate housing 20 by a pluralty of shock and vibration isolators such as springs 22 and 23. Housing 20 is attached to a base support 25, preferably by welding, which is secured to the transport means, not shown, by bolting through holes 26. Springs 22, 23 are welded or otherwise secured at their respective ends to housing 20 and plate 12 and serve to support or carry plate 12 and sensors 15–18 in a floating form of suspension. Vertical positioning of plate 12 is effected through a pair of bolts 30 and 31 which are threaded through respective collar bearings 32 and 33 that are disposed within springs 22 and 23, respectively, and are secured preferably by welding to housing 20. A plurality of alignment posts 35 and 36 equal in number to bearings 32 and 33 are attached to base support 25 in axial alignment with respective bearings and bolts. The bolts extend through plate 12 in enlarged bores as indicated at 37 and 38, so as to provide a desired lateral play of plate 12, and terminate within posts 35, 36 in both the transport and installed conditions. A plurality of retaining rings 40 and 41 are secured to the respective bolts a sufficient distance from their ends to permit selected vertical movement of plate 12 when bolts 30 and 31 are backed out as shown.

In FIG. 2, plate 12 is shown in the installed condition wherein bolts 30 and 31 have been turn fully into bearings 32 and 33, bringing retaining rings 40 and 41 in plate 12 into firm contact against posts 35 and 36.

Figure 3:
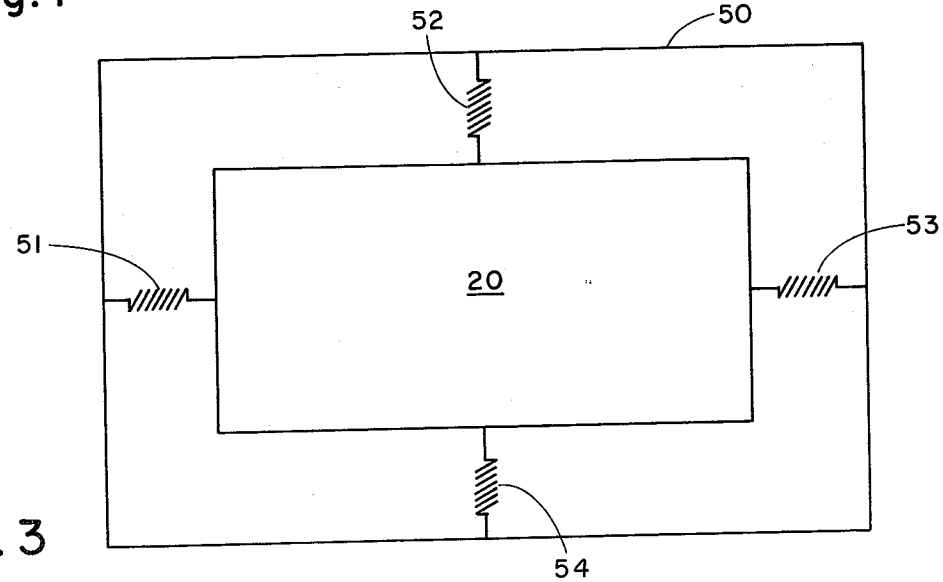
FIG. 3 is a schematic drawing showing the manner in which the embodiment of FIGS. 1 and 2 is transported.

FIG. 3 shows housing 20 suspended in an outer casing 50 for transport. A plurality of springs or other shock/vibration absorbing means 51–54 space the housing from the casing.

Figure 1:
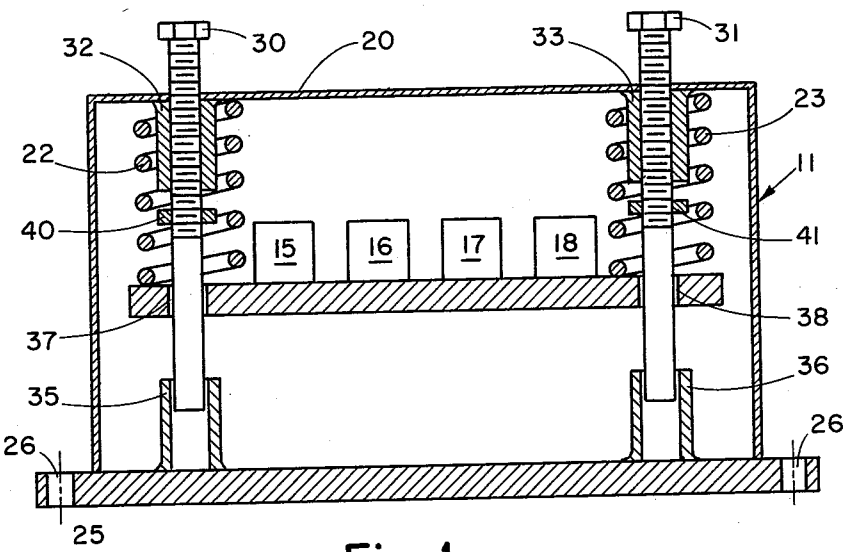
FIG. 1 is a sectional schematic drawing of one embodiment of the invention in the floating or transport condition.
Figure 5:
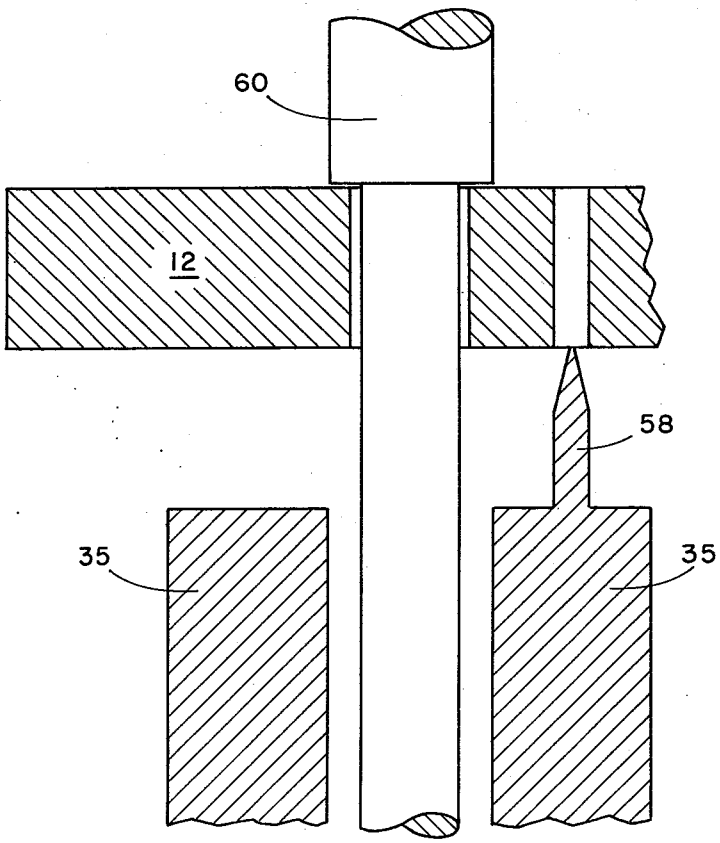
FIG. 5 is a schematic drawing of an alternate system for use with the embodiment of FIGS. 1 and 2.
Figure 4:
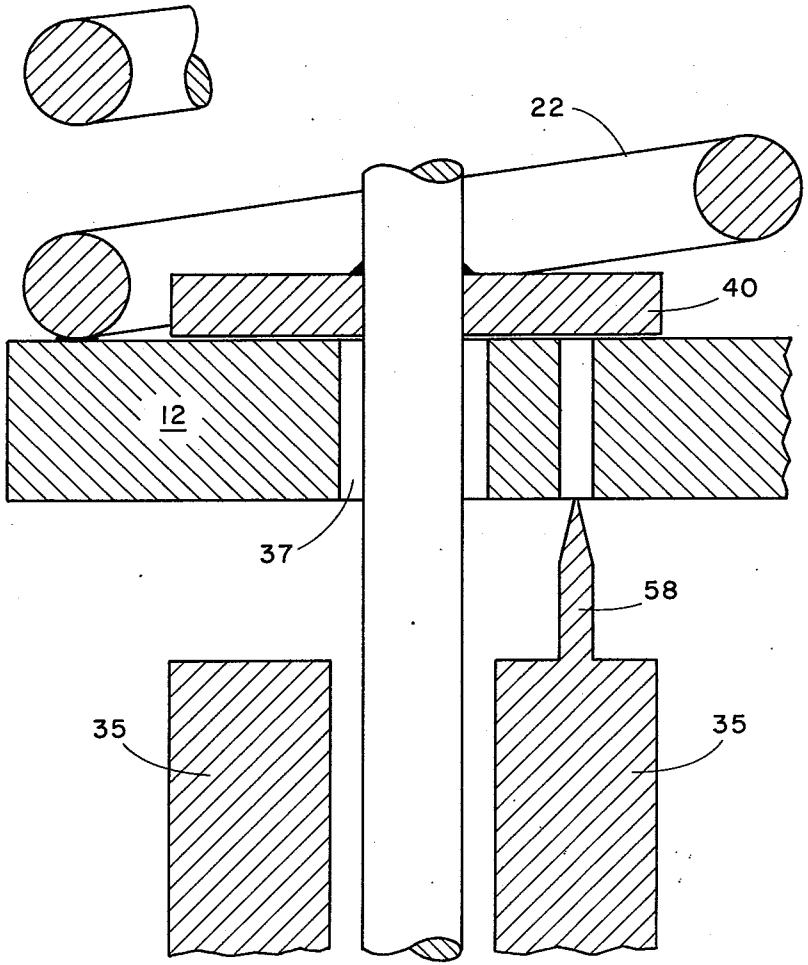
FIG. 4 is a schematic drawing illustrating construction details of the embodiment of FIGS. 1 and 2.

FIG. 4 is an enlarged drawing of the construction details of the embodiment of FIGS. 1 and 2 and further includes a tapered pin 58 which is secured to post 35 to provide precision alignment and lateral restraint in the installed condition. FIG. 5 shows an alternate support means wherein a shoulder bolt 60 replaces the retaining ring in forcing plate 12 against post 35.

In operation, individual sensors 15–18 are mounted on a machined plate 12 which is used to control their alignment with respect to each other. In the transport position, bolts 30 and 31 are unscrewed to a desired position such as the one shown in FIG. 1 where the clearance between retaining rings 40 and 41 and plate 12 is equal to or greater than the vertical excursion predicted for the most severe shock to be encountered. The steady state or at rest length of springs 22 and 23 should be such as to position plate 12 at the vertical midpoint between the top of posts 35 and 36 and the bottom of retaining rings 40 and 41. Plate 12 is suspended from housing 20 by shock/vibration isolators to provide protection during handling. Both vertical and horizontal shock loads are absorbed by absorption means 51–54 which suspend the housing in outer casing 50 for transport. When installed in the intended vehicle, bolts 30 and 31 are tightened in place thereby insuring via pin 58 proper orientation within the housing. Retaining rings 40 and 41 or shoulder bolt 60 force plate 12 into firm contact with posts 35 and 36 thereby assuring the same quality of security as though the sensors had been fastened directly to the base of the unit.

Obviously, many modifications and variations of the invention are possible in the light of the foregoing teachings. For example, the shoulder bolts shown in FIG. 5 may be used to replace retaining rings 40 and 41 to provide an easier and less costly fabrication and assembly. In the transport position, the bottom of the shoulder section would be at the equivalent position of retaining rings 40 and 41.

What is claimed is:

1. A resilient remotely securable mounting for fragile instruments and other objects comprising:

a form to which said objects are permanently secured;

a housing and means resiliently suspending said form therein selectively spaced therefrom to permit movement in response to excursions from shocks;

means extending into said housing and aligned with said resiliently suspending means for limiting and arresting lateral and vertical movement of said form; and a transport casing and means for resiliently suspending said housing therein during transport, whereby said objects are protected during handling and installation by being resiliently suspended in said housing and during shipment by resilient suspension of said housing in said casing, and said objects are permanently secured at the installation site by operation of said means limiting and arresting lateral and vertical movement.

2. The mounting as defined in claim 1 wherein said means resiliently suspending said form include at least two coil springs having respective ends affixed to said housing and said form, and at least part of said movement limiting means are disposed within respective springs.

3. The mounting as defined in claim 2 wherein said movement limiting means include at least two partially threaded bolts which extend a selected distance outside of said housing during handling and shipment and threaded collars in said housing receiving said bolts, said threaded collars affixed to said housing within said coil springs.

4. The mounting as defined in claim 3 wherein said movement limiting means further include alignment means secured to said housing remote from and in register with said collars for receiving and maintaining desired alignment of the unthreaded ends of said bolts; and stop means affixed to said bolts a selected distance from said collars in the transport position so as to bind said form against said posts in the installed position.

5. The mounting as defined in claim 4 and further including an alignment pin affixed to at least one of said posts and a recess in said form for receiving said pin in close fitting relationship so as to more precisely orient said form in the installed position.

6. The mounting as defined in claim 5 wherein said form is a plate and said bolts extend through said plate in enlarged openings to permit limited lateral movement of said plate with respect to said bolts.

7. A transport and installation system for fragile items such as instruments and/or components thereof comprising:

a housing and a member therein to which said items are secured in their ultimate installed position;

means resiliently suspending said member centrally in said housing;

means actuable from outside said housing and aligned with said resiliently suspending means for limiting and arresting movement of said member with respect to said housing; and a transport casing and means for resiliently suspending said housing therein during transport, whereby said items are protected in said housing during handling and installation by said resiliently suspended housing and during shipment by resilient suspension of said housing in said casing, and said items are permanently securable at the installation site solely by remote actuation of said means for limiting and arresting movement.

8. The system as defined in claim 7 wherein said means for limiting and arresting movement includes at least two rod members which extend a selected distance outside of said housing during handling and shipment and guide means secured in said housing above and below said member for receiving and maintaining desired alignment of said rod members, said rod members upon full actuation binding said member to said guide means remote from the operable end of said rod members at the installation site.

9. The system as defined in claim 8 wherein said rod members extend through said member in an enlarged opening therein to permit limited lateral movement with respect to said member; and stop means affixed to said rod members for effecting binding of said member to said remote guide means.

10. The system as defined in claim 9 wherein said means resiliently suspending said member include at least two helix means having respective ends affixed to said housing and said member, the upper of said guide means disposed within respective helix means, said stop means including retaining rings affixed to respective rod members, said retaining rings and said remote guide means spaced a distance from said member in the transport position at least equal to the excursion expected from the most severe shock to be encountered.

11. The system as defined in claim 10 and further including an alignment pin affixed to at least one of said remote guide means and a recess in said member for receiving said pin in close fitting relationship so as to more precisely orient said member in the installed position.

* * * * *